US010316563B2

(12) United States Patent
Flothmann et al.

(10) Patent No.: US 10,316,563 B2
(45) Date of Patent: Jun. 11, 2019

(54) OPENING AND CLOSING MECHANISM COMPRISING A DEAD-CENTER SPRING ELEMENT

(71) Applicant: fischer automotive systems GmbH & Co. KG, Horb a.N. (DE)

(72) Inventors: Jörg Flothmann, Bondorf (DE); Gunter Leopold, Baiersbronn (DE)

(73) Assignee: fischer automotive systems GmbH & Co. KG, Horb a.N. (DE)

( * ) Notice: Subject to any disclaimer, the term of this patent is extended or adjusted under 35 U.S.C. 154(b) by 0 days.

(21) Appl. No.: 15/825,380

(22) Filed: Nov. 29, 2017

(65) Prior Publication Data

US 2018/0155973 A1 Jun. 7, 2018

(30) Foreign Application Priority Data

Dec. 1, 2016 (DE) ..... 10 2016 123 242
Nov. 16, 2017 (DE) ..... 10 2017 127 030

(51) Int. Cl.
*E05F 1/14* (2006.01)
*E05D 15/58* (2006.01)
*E05F 1/10* (2006.01)
*E05D 15/40* (2006.01)

(52) U.S. Cl.
CPC ..... *E05F 1/14* (2013.01); *E05D 15/58* (2013.01); *E05F 1/1008* (2013.01); *E05D 15/408* (2013.01)

(58) Field of Classification Search
CPC ..... E05F 1/14; E05F 1/1008; E05F 15/408
See application file for complete search history.

(56) References Cited

U.S. PATENT DOCUMENTS 4,112,543 A * 9/1978 Rock ..... E05D 11/1021 16/307
4,114,237 A * 9/1978 Grass ..... E05D 11/1021 16/294
4,347,644 A * 9/1982 Lautenschlager ... E05D 11/1021 16/294
4,927,047 A 5/1990 Stuber et al.
5,628,486 A * 5/1997 Rossman ..... B60N 3/102 224/926
5,842,234 A * 12/1998 Dixon ..... A47K 13/06 4/235
2004/0226138 A1* 11/2004 Harmon ..... E05D 11/1064 16/284
2010/0109497 A1* 5/2010 Blersch ..... E05D 3/18 312/405

FOREIGN PATENT DOCUMENTS

DE 72 16 891 U 8/1972
DE 10 2004 019 784 B3 12/2005
EP 2 290 183 A1 3/2011

OTHER PUBLICATIONS

German Search Report dated Nov. 6, 2017 for corresponding German Application No. 10 2016 123 243.2.

* cited by examiner

*Primary Examiner* — Gregory J Strimbu
(74) *Attorney, Agent, or Firm* — Renner Otto Boisselle & Sklar, LLP

(57) ABSTRACT

An opening and closing mechanism includes a dead-center spring element for a swivelable part, and a control curve is provided on a side wall of the swivelable part, and the dead-center spring element engages the control curve via a swivelable control lever to control an opening and closing force progression with the aid of the control curve.

6 Claims, 3 Drawing Sheets

OPENING AND CLOSING MECHANISM COMPRISING A DEAD-CENTER SPRING ELEMENT

CROSS-REFERENCE TO RELATED APPLICATIONS

This application claims priority under 35 USC § 119 to German Patent Application Nos. 10 2016 123 242.4, filed on Dec. 1, 2016, and 10 2017 127 030.2, filed on Nov. 16, 2017, the entire disclosures of which are incorporated herein by reference.

TECHNICAL FIELD OF THE INVENTION

The invention relates to an opening and closing mechanism comprising a dead-center spring element and a movable part. The movable part can be a flap, or a sliding element, a swivelable or displaceable cover, or a compartment which can be opened via swiveling, being pulled open, or displaced. The list is an example and is not conclusive.

BACKGROUND OF THE INVENTION

A dead-center spring element can be any spring element, in principle. The function thereof determines that a movable part is acted on in the direction of a closed position when the movable part is located between dead center and a closed position, and the movable part is acted on in the direction of a usage position when the movable part is located between dead center and the usage position. In addition, the dead-center spring element holds the movable part in the closed position or in the usage position. The closed position and the usage position can also be referred to, in general, as the first position and the second position or as one position and the other position of the movable part. Dead center is located between the closed position and the open position, but not necessarily at the center between these two positions. The dead center is a point at which the dead-center spring element acts on the movable part neither in one direction nor in the other direction. The dead center can shift depending on a direction of motion of the movable part. The function of a dead-center spring element is achieved, as stated, not by means of a special spring element, but rather by means of mechanics, guidance, deflection, and/or a geometric arrangement of the dead-center spring element and the movable part.

European patent application EP 2 290 183 A1 discloses a box-shaped storage compartment comprising a swiveling lid as a movable part, and a dead-center spring element which swivelably engages at a lever arm of the swiveling lid and swivelably rests on a side wall of the storage compartment, as an abutment. During opening and closing of the swiveling lid, an engagement point of the dead-center spring element moves on a circular path on the lever arm of the swiveling lid about a swivel axis of the swiveling lid. A geometry is selected in such a way that, during opening and closing of the swiveling lid, the engagement point of the dead-center spring element first approaches the support of the dead-center spring element on the side wall of the storage compartment and subsequently moves away therefrom. As a result, the dead-center spring element is initially tensioned and relaxes after the dead center has been overcome, wherein the dead-center spring element acts on the swiveling lid further in a direction of motion until a closed position or a usage position, in which the storage compartment is open and accessible, has been reached, and holds the swiveling lid in this position. One embodiment of the known storage compartment utilizes a compression spring in a telescopic tube, the spring being hinged to the side wall of the storage compartment and to the lever arm of the swiveling lid. Yet another embodiment utilizes a leg spring, the one leg of which is suspended on the lever arm of the swiveling lid and the other leg of which is suspended in the side wall of the storage compartment.

In known dead-center spring elements, the dead-center spring element is tensioned the most at dead center and the spring force of the dead-center spring element is greatest at dead center. It would be desirable to have, conversely, a low spring force at dead center and a high force in the closed position and/or in the usage position. As a result, the force necessary for opening and closing the movable part and for moving the movable part from a closed position into a usage position and vice versa, would be low in the vicinity of dead center, and a spring force, with the aid of which the dead-center spring element holds the movable part in the closed position and/or in the usage position, would be high. In the case of misuse, i.e., for example, in the case of forces in the opening direction that are greatly increased as compared to the forces necessary for a planned opening action, the known systems also have the problem that the opening and closing mechanism is destroyed. This relates to the dead-center spring element as well as to the relevant guides, joints, and stops.

SUMMARY OF THE INVENTION

The object of the invention is to provide an opening and closing mechanism comprising a dead-center spring element, which is robust against overload in the case of misuse, and in which the spring force of the dead-center spring element at dead center is lower than, or at most as great as, that in a closed position or an open position, or with which at least the increase in the spring force starting from the closed position or the open position toward dead center is lower.

This object is achieved according to the invention by an opening and closing mechanism having the features described herein. The opening and closing mechanism according to the invention comprises a stop, which limits the opening motion of a movable part and elastically gives way upon application of increased forces in the opening direction. "Increased forces" are forces that are greater than the forces necessary for a planned usage to move the movable part from a closed position into a usage position. The forces necessary for a planned movement can be referred to as "usage forces", while the increased forces can be referred to as misuse forces, which can occur, for example, as the result of an impact onto the movable part, by way of which the movable part is acted upon in the opening direction. The stop limits the opening motion of the movable part in the usage position, and therefore the opening motion continues until the usage position has been reached. The stop can be overcome in the opening direction, however, and therefore the stop elastically gives way upon application of misuse forces such that the movable part can be moved into a misuse position. The usage forces, in particular the forces applied onto the movable part by the dead-center spring element in the usage position, are insufficient for overcoming the stop. Due to the resilience of the stop, on the one hand, the movable part is held in the usage position by the stop against the force of the dead-center spring. On the other hand, the resilient stop ensures that neither the stop itself, nor other elements such as guides, joints, or the like, are damaged in the event of overload. By swiveling back into the closed position and overcoming the stop again, the swivel compartment can be repaired again, which is to say, moved into a position for the planned usage. So that the dead-center spring element is likewise not destroyed in the event of an overload, the invention also provides that the closing mechanism comprises a control curve, at which a dead-center spring element directly or indirectly engages. The control curve can be disposed on a movable part or can be fixed. "Fixed" means that the movable part is movable with respect to the control curve. Starting from a dead center, which is a position of the movable part between the closed position and the usage position, the dead-center spring element acts on the movable part in the direction of the closed position or the usage position depending on which side of the dead center the movable part is located. The closed position and the usage position can also be referred to, in general, as two end positions of the movable part. By way of a geometry of the control curve at which the dead-center spring element engages, a force or a force component, which the dead-center spring element applies onto the movable part, in a direction of motion of the movable part can be controlled. With the aid of the control curve, increases in force starting from the closed position and/or the usage position in the direction of dead center can be reduced, and a force can also be achieved that remains approximately constant or even decreases toward dead center, which the dead-center spring element applies onto the movable part in or counter to the direction of motion. In the latter case, the force that the dead-center spring element applies onto the movable part in the direction of motion is preferably greatest in the closed position and/or in the usage position, and therefore the movable part is held closed and/or open with high force.

One embodiment of the invention provides a swivelable part as a movable part, for example a flap, a swiveling lid, or a swivel compartment. If the movable part is a swiveling lid, then a storage compartment in a motor vehicle, on which the swiveling lid is disposed, is closed in the closed position, for example by the swiveling lid, while the storage compartment is open in the usage position and is accessible from the passenger compartment.

One refinement provides that, starting from a point of the control curve assigned to the dead center of the movable part, which is referred to in the following as the dead-center point, the control curve extends in such a way that a line of action of the spring force of the dead-center spring element moves away from a swivel axis of the movable part as the distance of the control curve from the dead-center point increases. The dead-center point of the control curve is the point at which the dead-center spring element engages when the movable part is located at dead center, which is to say, is acted upon by the dead-center spring element not in a direction of motion, but rather perpendicularly to the direction of motion, without a force component in a direction of motion. If the distance of the line of action of the dead-center spring element from the swivel axis of the movable part increases radially with respect to the line of action of the spring force of the dead-center spring element and radially with respect to the swivel axis of the movable part as the distance from dead center increases, the lever arm, with the aid of which the dead-center spring element engages at the movable part with respect to the swivel axis, increases in size. As a result, depending on the geometry of the control curve, compensation, including over- or under-compensation, of the spring force of the dead-center spring element is possible, the spring element relaxing as the distance from dead center increases, whereby the spring force thereof decreases.

One embodiment of the invention provides that the distance of the control curve, at which the dead-center spring element engages, from a swivel axis of a movable, namely swivelable, part decreases as the distance from the dead-center point increases. The line of action of the spring force of the dead-center spring element thus moves away from the swivel axis of the movable part as the distance from dead center increases, thereby increasing the size of the effective lever arm, with the aid of which the dead-center spring element engages at the movable part.

In one embodiment of the invention, the control curve is angled at the dead-center point, which is also understood to mean a curve having a small radius.

One preferred embodiment of the invention provides that the dead-center spring element snaps in at the control curve in the closed position and/or in the open position of the movable part. This increases the holding force, with the aid of which the dead-center spring element holds the movable part closed and/or open.

One preferred embodiment of the invention provides that the dead-center spring element engages at a swivelable control lever, which itself engages at the control curve. The dead-center spring element therefore does not engage directly at the control curve, but rather indirectly via the swivelable control lever.

BRIEF DESCRIPTION OF THE DRAWINGS

The invention is described in greater detail in the following with reference to an exemplary embodiment shown in the drawings. The drawings are a simplified and schematized depiction for ensuring an understanding of the invention and for describing the invention.

DETAILED DESCRIPTION OF THE INVENTION

Figure 1:
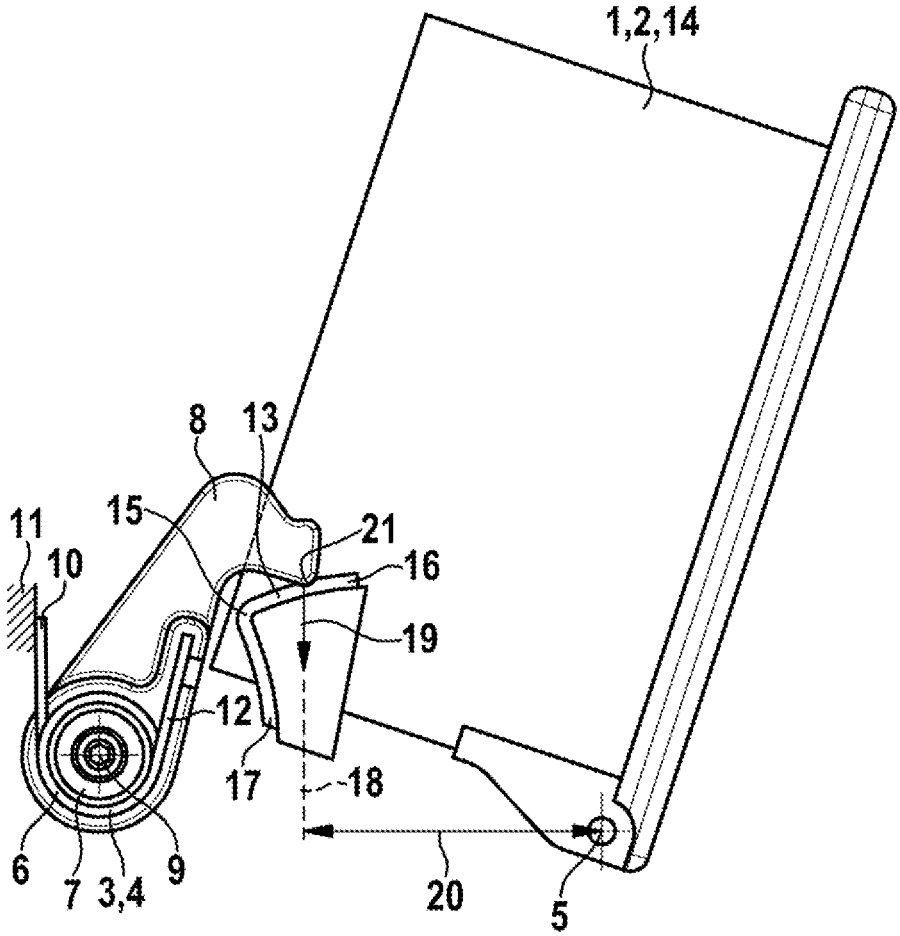
FIG. 1 shows a side view of an opening and closing mechanism including a dead-center spring element according to an exemplary embodiment in a closed position.
Figure 2:
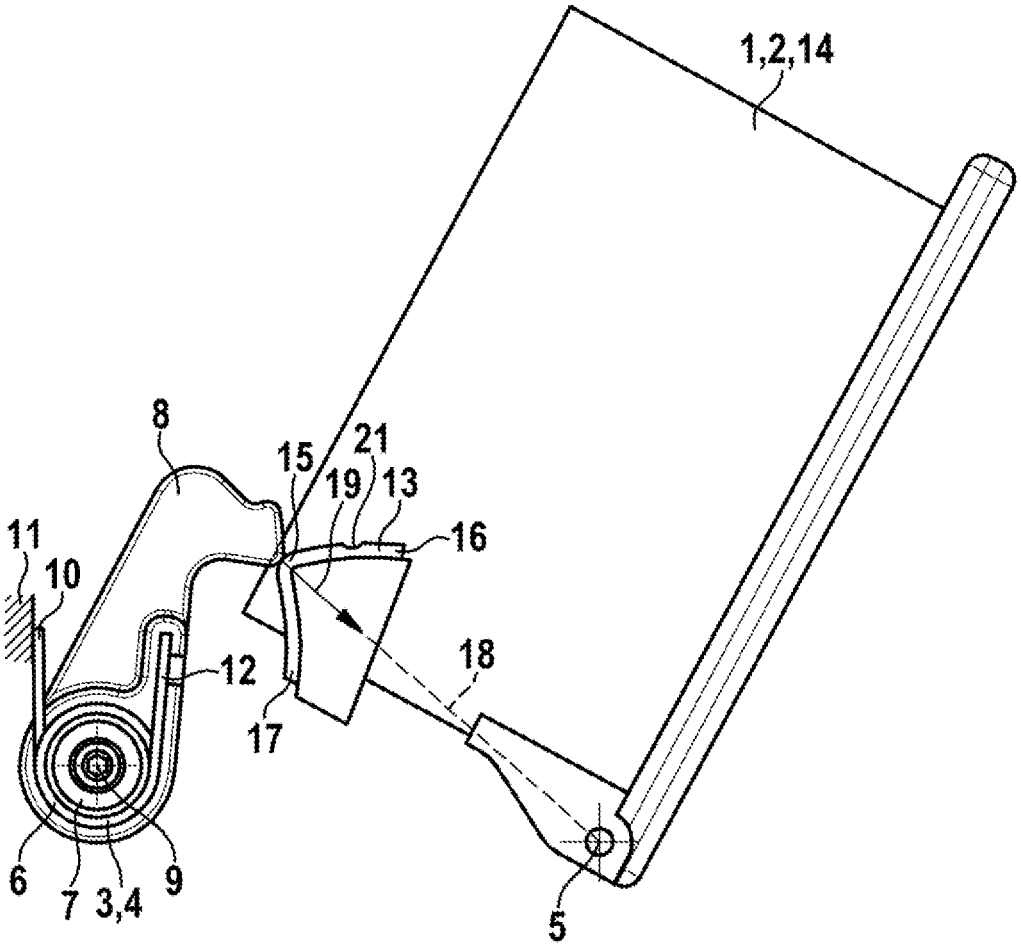
FIG. 2 shows the opening and closing mechanism including the dead-center spring element in a dead-center position.
Figure 3:
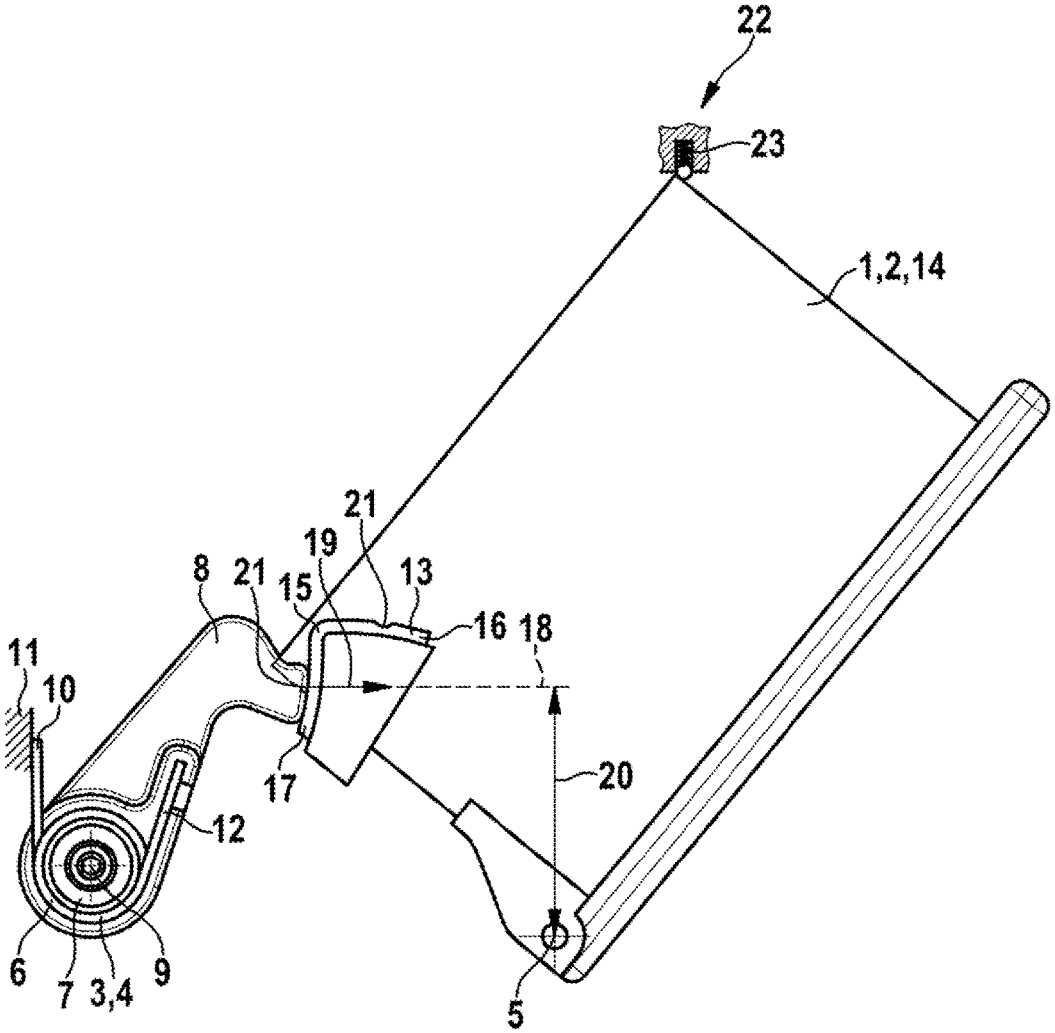
FIG. 3 shows the opening and closing mechanism including the dead-center spring element in a usage position.

The opening and closing mechanism according to the invention, which is depicted in the drawings, includes a swivel compartment 1 as a movable, namely swivelable part 2, and a leg spring 3 as a dead-center spring element 4. The movable part 2 is swivelable about a swivel axis 5 from a closed position, which is shown in FIG. 1, into an open position, which is shown in FIG. 3, and vice versa. FIG. 2 shows the movable part 2 in a dead-center position, which is located between the closed position and the usage position. The closed position and the usage position can also be referred to, in general, as two planned end positions of the movable part 2 for a planned usage.

A spring coil 6 of the leg spring 3 forming the dead-center spring element 4 is accommodated on a fixed bearing journal 7, on which a control lever 8 is swivelably mounted. A swivel axis 9 of the control lever 8 extends parallel to and at a distance from the swivel axis 5 of the swivel compartment 1 forming the movable part 2. One spring leg 10 of the leg spring 3 rests against a fixed abutment 11 and another spring leg 12 of the leg spring 3 acts on the control lever 8 in the direction of the swivel axis 5 of the movable part 2.

The control lever 8 is angled and is pressed by the leg spring 3 forming the dead-center spring element 4 against a control curve 13, which is disposed on a side wall 14 of the swivel compartment 1 forming the movable part 2. The control curve 13 is angled and, starting from an angular deflection 15, comprises a closing section 16 and, on another side of the angular deflection 15, comprises an opening section 17, the two sections approaching each other with slight curvatures tangentially to the swivel axis 5 of the movable part 2 of the opening and closing mechanism according to the invention. If the movable part 2 is located between the dead-center position shown in FIG. 2 and the closed position shown in FIG. 1, the leg spring 3 forming the dead-center spring element 4 presses the angled control lever 8 against the closing section 16 of the control curve 13. A line of action 18 of a spring force 19, which is depicted using an arrow and which is applied onto the control curve 13 by the dead-center spring element 4, extends perpendicularly to the control curve 13, assuming there is no friction. The profile of the closing section 16 of the control curve 13 is selected in such a way that the distance 20 of the line of action 18 of the spring force 19 from the swivel axis 5 of the movable part 2 increases as the distance of the movable part 2 from the dead-center position increases and the movable part approaches the closed position. The distance 20 is to be measured radially with respect to the line of action 18 and the swivel axis 5. The distance 20 of the line of action 18 of the spring force 19 of the dead-center spring element 4 from the swivel axis 5 of the movable part 2, which increases during the approach to the closed position, means that the lever arm, with which the dead-center spring element 4 engages at the control curve 13 via the control lever 8, increases in size. As a result, the decreasing spring force of the dead-center spring element 4, which relaxes during the approach to the closed position, can be partially compensated for, completely compensated for, or over-compensated for, depending on the profile of the closing section 16 of the control curve 13. The closing force, which is applied onto the movable part 2 by the dead-center spring element 4 in the direction of the closed position, thus decreases by a lesser extent than the spring force of the dead-center spring element 4, or remains constant, or even increases.

In the closed position of the movable part 2, the angled control lever 8 snaps into a recess 21 in the closing section 16 of the control curve 13, by which the movable part 2 is held closed in the closed position, as well as by the spring force applied by the dead-center spring element 4. Such a recess can also be provided for the usage position of the movable part 2 in the opening section 17 of the control curve 13. The exemplary embodiment comprises the recess 21 only for the closed position.

The opening section 17 of the control curve 13 extends, according to the description provided above, to the closing section 16 in such a way that the distance of the line of action 18 of the spring force 19 of the dead-center spring element 4 from the pivot axis 5 of the swivel compartment 1 forming the movable part 2 increases when the movable part 2 approaches the usage position, starting from the dead-center position. As a result, during the opening of the movable part 2 as well, after the dead center has been overcome, a force applied by the dead-center spring element 4 via the control lever 8 onto the movable part 2 in an opening direction decreases by a lesser extent than the spring force of the dead-center spring element 4, does not decrease, or even increases, when the movable part 2 approaches the usage position.

In the dead-center position of the swivel compartment 1 forming the movable part 2, as shown in FIG. 2, the dead-center spring element 4 presses the control lever 8 against the angular deflection 15 of the control lever 8 and the line of action 18 of the spring force 19 of the dead-center spring element 4 intersects the swivel axis 5 of the movable part 2, and therefore the movable part 2 is acted on neither in the direction of the closed position nor in the direction of the usage position. The angular deflection 15 of the control curve 13 can also be referred to as a dead-center point of the control curve 13.

The dead-center spring element 4 is preloaded both in the closed position and in the usage position of the swivel compartment 1 forming the movable part 2; in the dead-center position, the tension and, therefore, the spring force of the dead-center spring element 4, are at their greatest.

A stop 22 in the form of a ball catch 23 is depicted only in FIG. 3. This stop 22 limits the opening motion of the swivel compartment 1 by way of the arrangement of the rear edge, shown at the top in the figure, in the usage position. In the event of increased force in the opening direction, for example due to misuse, the ball catch 23 gives way, and therefore the stop 22 can be overcome and the swivel compartment 1 will be in a misuse position. Neither the stop 22 nor the dead-center spring element 4 is damaged as a result. By swiveling back into the closed position and overcoming the stop 22 again, the swivel compartment can be repaired again, i.e., moved into a position for the planned usage.

The invention claimed is:

1. An opening and closing mechanism comprising:

a movable part movable from a dead-center position to a closed position and from the dead-center position to a usage position, wherein the dead-center position is between the closed position and the usage position;

a dead-center spring element which acts on the movable part;

a control curve mounted on the movable part, the control curve being engageable by the dead-center spring element and having an angular deflection, wherein:

when the dead-center spring element engages the control curve on one side of the angular deflection, the dead-center spring element urges the movable part in a closing direction toward the closed position to move the movable part toward the closed position, when the dead-center spring element engages the control curve on a side of the angular deflection opposite the one side, the dead-center spring element urges the movable part in an opening direction toward the usage position to move the movable part toward the usage position, and when the dead-center spring element engages the angular deflection, the dead-center spring element urges the movable part neither in the opening direction or in the closing direction, whereby a moment that the dead-center spring element applies on the movable part is zero and the movable part is in the dead-center position;

a stop which limits an opening motion of the movable part in the opening direction and which is overcome when a misuse force is applied to the movable part in the opening direction, whereby the stop is elastically deformed and the movable part is moveable to a misuse position which is past the usage position in the opening direction.

2. The opening and closing mechanism according to claim 1, wherein a moment which the dead-center spring element applies to the movable part, when the movable part is in the closed position or in the usage position, is greater than a moment the dead-center spring element applies to the movable part when the movable part is adjacent the dead-center position.

3. The opening and closing mechanism according to claim 1, wherein the movable part is swivelably mounted and the angular deflection is a dead-center point which the dead-center spring element engages when the movable part is in the dead-center position.

4. The opening and closing mechanism according to claim 3, wherein the control curve is curved at the dead-center point.

5. The opening and closing mechanism according to claim 1, wherein the dead-center spring element is configured to snaps into a recess of the control curve when the movable part is in the closed position and snap into a recess of the control curve when the movable part is in the usage position.

6. The opening and closing mechanism according to claim 1, wherein the dead-center spring element includes at a swivelable control lever which engages the control curve.

* * * * *